US005924880A

United States Patent [19]

Watanabe et al.

[11] Patent Number: 5,924,880

[45] Date of Patent: Jul. 20, 1999

[54] LOW COUPLING FORCE CONNECTOR ASSEMBLY

[75] Inventors: Hiroshi Watanabe; Isao Kameyama, both of Shizuoka, Japan

[73] Assignee: Yazaki Corporation, Tokyo, Japan

[21] Appl. No.: 09/058,815

[22] Filed: Apr. 13, 1998

[30] Foreign Application Priority Data

Apr. 14, 1997 [JP] Japan ..... 9-095588
Sep. 4, 1997 [JP] Japan ..... 9-239569

[51] Int. Cl.[6] ..... H01R 13/62

[52] U.S. Cl. ..... 439/157; 439/310

[58] Field of Search ..... 439/157, 310, 439/372, 377, 374, 152, 153

[56] References Cited

U.S. PATENT DOCUMENTS 5,171,156 12/1992 Nagasaka et al. ..... 439/157
5,205,752 4/1993 Taguchi et al. ..... 439/157

FOREIGN PATENT DOCUMENTS 5-114436 5/1993 Japan .
8-241756 9/1996 Japan .

*Primary Examiner*—Steven L. Stephan
*Assistant Examiner*—Javaid Nasri
*Attorney, Agent, or Firm*—Armstrong, Westerman, Hattori, McLeland & Naughton

[57] ABSTRACT

A low coupling force connector assembly is provided which has a first connector and a second connector. The first connector includes a housing and a cam projection provided on the housing, and the second connector includes a housing and a straight guide groove for guiding the cam projection of the first connector. A guide member accommodates therein the first connector and guides the second connector to the first connector. The guide member has a rib projectiong on a housing wall thereof. Locking means hold the first connector in position in the guide member. A rotary plate with two lever projections is rotatably provided on the second connector. The first and second connectors are coupled together with a low coupling force concurrently with mounting a component on a vehicle instrument panel.

9 Claims, 10 Drawing Sheets

LOW COUPLING FORCE CONNECTOR ASSEMBLY

BACKGROUND OF THE INVENTION

1. Field of the Invention

This invention relates to a connector assembly consisting of connectors provided on two members to be assembled to each other, for example, an instrument panel of a vehicle and a component to be mounted on the instrument panel, and more particularly to a low coupling force connector assembly which enables the component and the instrument panel to be connector-connected concurrently with mounting the component on the instrument panel and which attains a reduction in the force required for coupling its connectors.

2. Description of the Related Art

To connector-connect two members concurrently with their assembly to each other, a connector assembly of a plug-in type is disclosed in Japanese Patent Application Laid-Open Specification No. Hei 8-241756, the connector assembly being shown in longitudinal section in FIG. 9.

In this figure, 110 designates an electronic component unit and 120 a chassis which receives the unit. The electronic component unit 110 has a female connector 131 projecting at the front, and the chassis 120 has a corresponding male connector 132 mounted via an adapter 132*a* on an innermost wall thereof. The male connector 132 is inserted into the female connector 131 to be coupled in a plug-in manner.

With such a structure, by pushing the electronic component unit 110 into the chassis 120, the male and female connectors 131 and 132 are coupled simultaneously with assembling the electric component unit 110 to the chassis 120.

There is a drawback, however, to the conventional plug-in type connector assembly in which the female and male connectors 131, 132 are simply pushed into coupling with each other that a large insertion force is required to couple the connectors in accordance with an increase in the number of terminals involved (multipolarization), often resulting in an incomplete coupling of the connectors 131, 132.

Another drawback is that, the larger the force required to couple the female and male connectors 131, 132, the larger the force required to push the electronic component unit 110 into the chassis 120. As a result, the casing for the electronic component unit 110 and the chassis 120 must be correspondingly given a higher rigidity.

To reduce the insertion force required to couple male and female connectors, a connector assembly with a lever is disclosed in Japanese Patent Application Laid-Open Specification No. Hei 5-114436, which connector is for use to connect vehicle-mounted wiring harnesses to each other and shown in longitudinal section in FIG. 10.

The connector assembly with a lever, as shown in FIG. 10, includes a connector box 210 attached to a vehicle panel 201, a male connector 220 having a housing received inside the connector box 210, a lever 230 rotatably provided on the housing of the male connector 220, and a female connector 240 matable with the male connector 220.

The female connector 240 is at a side wall thereof provided with a cam projection 241, and the lever 230 is formed with a substantially arc-like cam groove 231 for guiding the cam projection 241 therein.

In the thus constructed conventional lever-equipped connector assembly, as shown in FIGS. 11A to 11D, after the male connector 220 is set in place in the connector box 210, the female connector 240 is aligned with the male connector 220 and pushed into the connector box 210 so that its cam projection 241 is introduced into the cam groove 231 of the lever 230, followed by rotating the lever 230 to bring the male and female connectors 220, 240 into coupling in the connector box 210 with a low insertion force.

There is a drawback, however, to the above conventional lever-equipped connector assembly that the completion of coupling the male and female connectors 220, 240 cannot be known through a tactile sense at pushing in the female connector 240 or visually on the outside appearance of the pushed-in female connector.

SUMMARY OF THE INVENTION

This invention has been accomplished to overcome the above drawbacks and an object of this invention is to provide a low coupling force connector assembly which enables two members to be connector-connected concurrently with their assembly to each other, which requires a reduced coupling force for the connector connection, and which enables a tactile and a visual confirmation of the completion of coupling of the connectors.

In order to attain the object, according to an aspect of this invention, there is provided a low coupling force connector which comprises: a first connector having a housing and a cam projection provided on the housing; a second connector having a housing with a receiver portion for receiving the first connector, the receiver portion having a straight guide groove formed in a wall thereof for guiding the cam projection of the first connector; a guide member with opposed side walls for receipt therebetween of the first connector and guiding the second connector to the first connector, one of the side walls having a rib projecting thereon; locking means for holding the first connector in position in the guide member; and a rotary plate rotatably provided on the wall of the second connector receiver portion, the rotary plate having at a peripheral edge thereof two lever projections for contacting the rib of the guide member to rotate the rotary plate in one or an opposite direction and a substantially arc-like cam groove for driving, during coupling and decoupling of the first and second connectors, the cam projection of the first connector to a terminal end or a beginning end of the guide groove in the second connector receiver portion in accordance with a direction of rotation of the rotary plate.

In the thus constructed low coupling force connector assembly, the first connector is first held in position in the guide member with the locking means, and the rotary plate on the second connector receiver portion is rotated to align beginning ends (open ends) of its cam groove and the guide groove to each other. The second connector is then advanced along the guide member to the first connector until the cam projection of the first connector is introduced into the guide groove of the second connector and the cam groove of the rotary plate.

If the second connector is thereafter further advanced into the first connector, one of the lever projections of the rotary plate comes into contact with the rib of the guide member to thereby rotate the rotary plate in one direction, at which time the cam groove of the rotary plate gives a force which drives the cam projection of the first connector toward the terminal end of the guide groove so as to couple the first and second connectors together.

Thus, according to this invention, due to the cam groove that drives the cam projection to the terminal end of the guide groove, the force required for inserting the first connector into the second connector is reduced, and the first connector may be coupled to the second connector simply by advancing the second connector along the guide member.

Advantageously, the low coupling force connector assembly further comprises an instrument panel of a vehicle and a component to be mounted on the instrument panel, and the guide member and thus the first connector are provided on the instrument panel and the second connector is provided on the component, and in inserting the second connector between the side walls of the guide member and mounting the component on the instrument panel, the first and second connectors are coupled to each other prior to or concurrently with completion of mounting the component on the instrument panel.

Advantageously, the low coupling force connector assembly further comprises an instrument panel of a vehicle and a component to be mounted on the instrument panel, and the second connector is provided on the instrument panel and the guide member and thus the first connector are provided on the component, and in inserting the second connector between the side walls of the guide member and mounting the component on the instrument panel, the first and second connectors are coupled to each other prior to or concurrently with completion of mounting the component on the instrument panel.

With the construction as mentioned above, simultaneous coupling of the first and second connectors with the mounting of the component on the instrument panel is attained, thereby enabling a "one-touch" installation of the component on the instrument panel.

Further, the completion of the first and second connector coupling can be known by the completion of the component installation through a tactile sense (e.g. at the abutment of the component inside the instrument panel) and visually (e.g. on the alignment of outer surfaces of the component and the instrument panel).

Preferably, the locking means comprises resilient locking claws projecting at the side walls of the guide member and corresponding locking recesses provided on opposite side walls of the first connector housing.

Preferably, the locking means comprises resilient locking claws projecting at opposite side walls of the first connector housing and corresponding locking recesses provided on the side walls of the guide member.

With the construction as mentioned above, the first connector is held in position in the guide member in a simple manner and easily releasable from locked position by advancing the second connector along the guide member.

Further, if the locking claws and the locking recesses remain locked to each other, it indicates that the first and second connectors are not yet coupled at which time the component cannot be mounted on the instrument panel, making it possible to know from outside whether or not the connectors are in coupled condition.

Preferably, the locking means comprises locking pieces in the form of a plate spring projecting at the side walls of the guide member and corresponding locking recesses provided on opposite side walls of the first connector housing.

Preferably, the low coupling force connector assembly further comprises guide grooves provided on the opposed side walls of the guide member and corresponding guide ribs provided on opposite side walls of the second connector housing for sliding engagement in the guide grooves.

The guide ribs slidable in the guide grooves facilitate the advancement of the second connector along the guide member.

According to another aspect of this invention, there is provided a low coupling force connector assembly which comprises: a male connector engaged in a mount hole provided in an instrument panel of a vehicle, the male connector having upper and lower female terminal accommodating chambers with a hollow space formed therebetween and a cam projection provided in the hollow space; a female connector provided on a component which is mounted on the instrument panel, the female connector having a receiver portion for receiving the male connector, the receiver portion having upper and lower male terminal accommodating chambers with a hollow space formed therebetween and a cutout longitudinally extended in a wall thereof; a rotary plate rotatably provided in the hollow space of the female connector receiver portion, the rotary plate having at a peripheral edge thereof two lever projections which project through the cutout for contacting a circumferential edge of the instrument panel mount hole to rotate the rotary plate in one or an opposite direction and a substantially arc-like cam groove for driving therealong the cam projection of the male connector to bring the male connector into and out of coupling with the female connector in accordance with a direction of rotation of the rotary plate.

In the construction as mentioned above, the male connector is in advance engaged in the instrument panel mount hole, and when mounting the component on the instrument panel, the female connector is inserted into the instrument panel mount hole, with the male connector inserted into the female connector receiver portion to introduce the cam projection of the male connector into the cam groove provided in the rotary plate in the female connector.

As the female connector is further pushed in, one of the lever projections of the rotary plate comes into contact with the circumferential edge of the instrument panel mount hole to rotate the rotary plate in one direction. Consequently, the cam projection follows the cam groove of the rotary plate toward the terminal end of the same to bring the male deeper into the female connector. On further pushing, the male connector is fully coupled to the female connector.

Thus, with the low coupling force connector assembly as mentioned above, as is the case with the preceding ones, the male and female connectors are coupled together simultaneously with mounting the component on the instrument panel, while dispensing with the guide member as in the preceding ones, leading to a simplified structure and a reduced weight.

Preferably, the low coupling force connector assembly further comprises escape holes provided in opposite walls of the female connector receiver portion and locking arms provided on corresponding opposite walls of the male connector for engagement with the instrument panel to position the male connector in the mount hole and for engagement in the escape holes in the female connector receiver portion.

In the above construction, the locking arms cooperate with the instrument panel to hold, relative to the female connector, the male connector in position in the instrument panel mount hole to enable a smooth coupling of the male and female connectors.

The above and other objects, features and advantages of this invention will become apparent from the following description and the appended claims, taken in conjunction with the accompanying drawings.

DESCRIPTION OF THE PREFERRED EMBODIMENTS

Embodiments of this invention will now be described with reference to the attached drawings.

Figure 1:
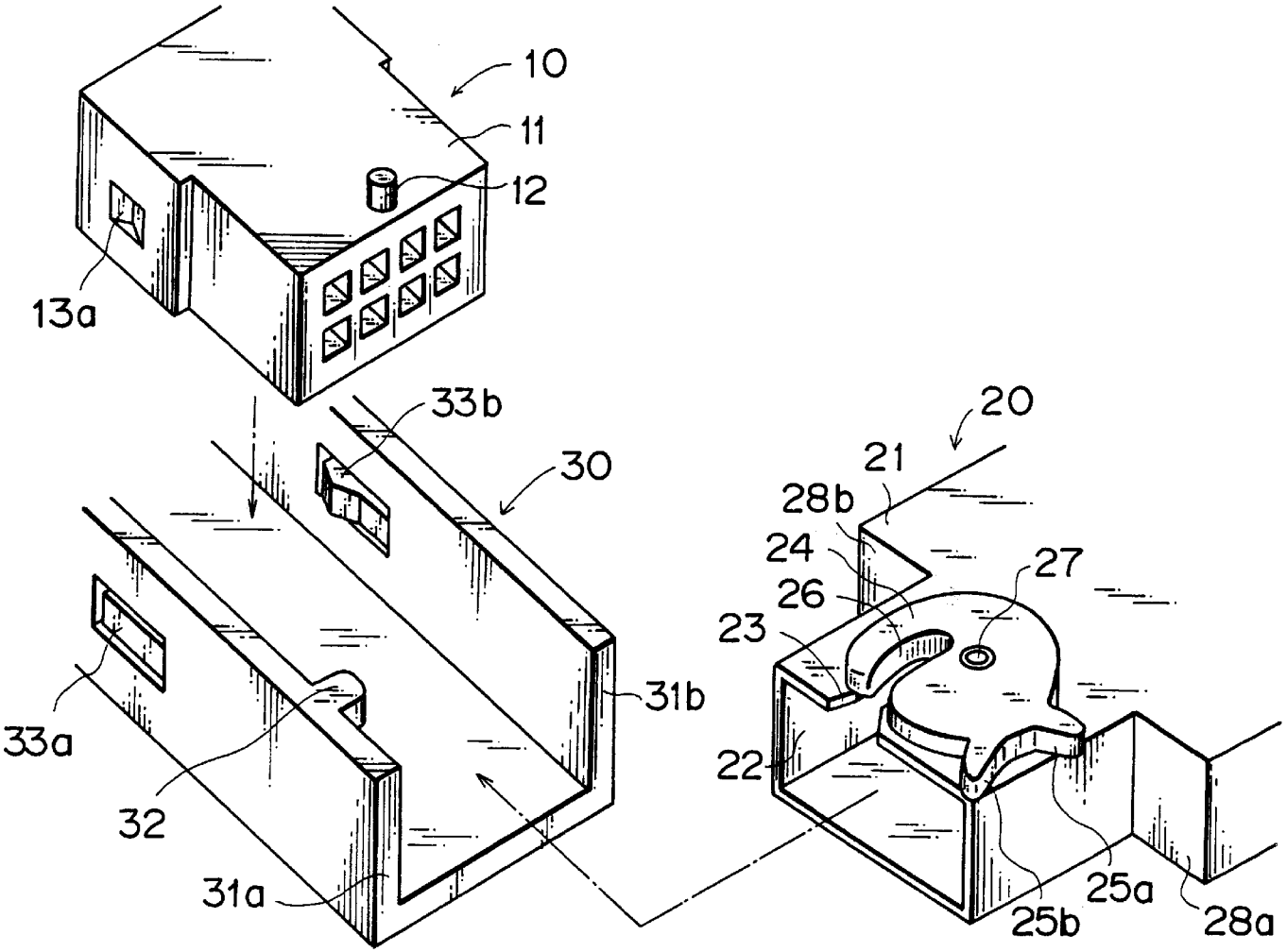
FIG. 1 is an exploded perspective view of a low coupling force connector assembly according to a first embodiment of this invention.
Figure 2:
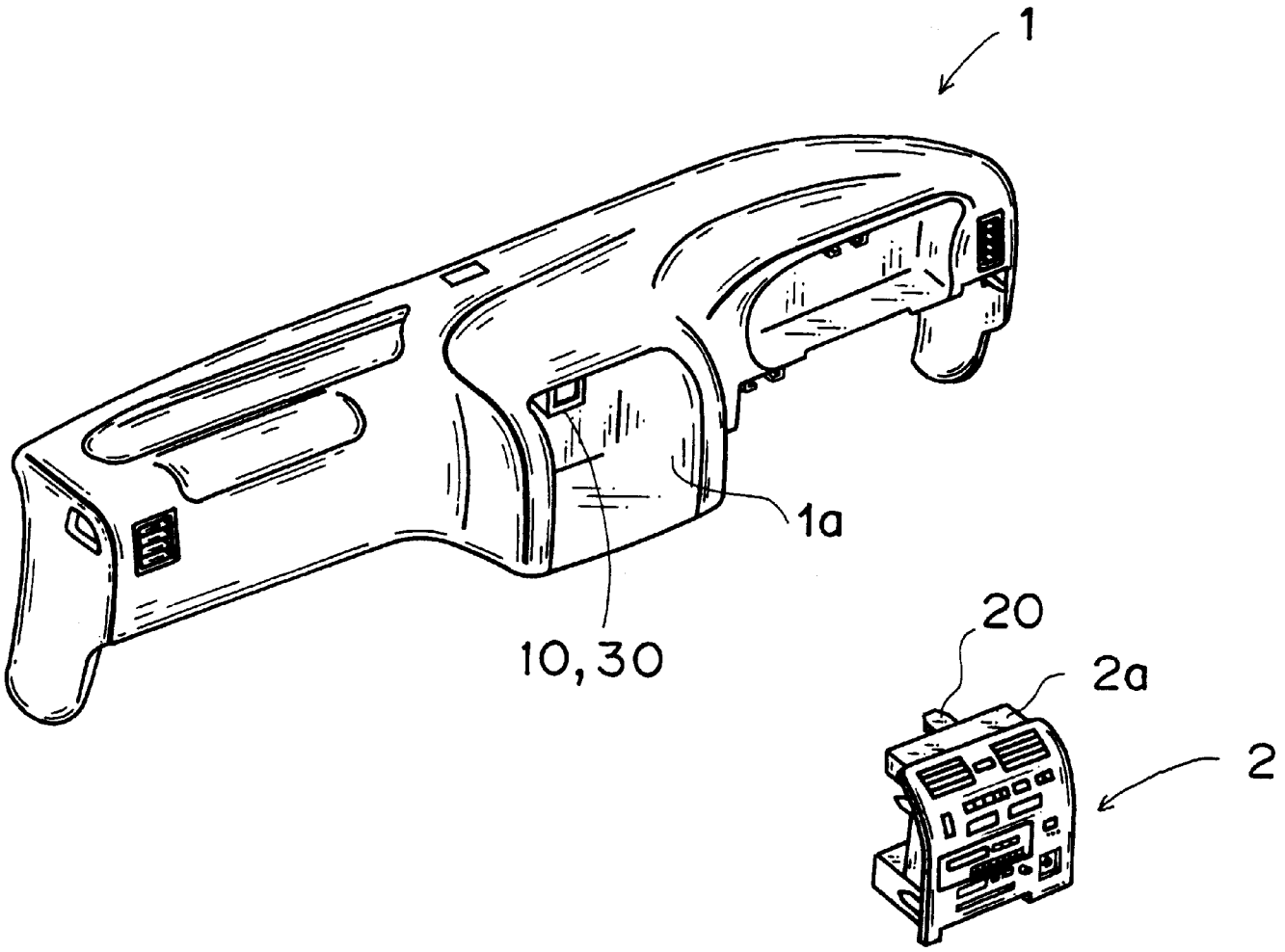
FIG. 2 is a perspective view showing an instrument panel and a component each with a connector of the low coupling force connector assembly as in FIG. 1.

A low coupling force connector assembly according to a first embodiment of this invention, as shown in FIGS. 1 and 2, includes a male connector 10 and a guide member 30, both provided on an instrument panel 1 of a vehicle, and a female connector 20 provided on a component 2 to be assembled to the instrument panel 1. The guide member 30 receives the male connector 10 and serves to guide the female connector 20 to the male connector 10.

The male connector 10 includes a housing 11 and a number of female terminals accommodated therein. The housing 11 has a cam projection 12 of circular section on a wall thereof at the front end and locking recesses 13*a,* 13*b* at its both sides corresponding to below-described locking claws 33*a,* 33*b* on the guide member 30.

The guide member 30 has opposed side walls 31*a,* 31*b* inside which the male connector 10 is received, and along which the female connector 20 is guided to the male connector 10. The guide member 30 also has a rib 32 projecting inwardly at one of the side walls 31*a*.

The side walls 31*a,* 31*b* are integrally formed with the respective locking claws 33*a,* 33*b* as mentioned above which are of resilience. The locking claws 33*a,* 33*b* engage in the locking recesses 13*a,* 13*b* of the male connector 10 to hold the male connector 10 in place inside the guide member 30.

The female connector 20 includes a housing 21 and a number of not-shown male terminals accommodated therein. The housing 21 has at the front end a receiver portion 22 for receiving the male connector 10, one wall of which is formed with a straight cam groove 23 for guiding the cam projection 12 of the male connector 10.

A rotary plate 24 is provided rotatable around a rotating shaft 27 on the one wall of the receiver portion 22. At its periphery, the rotary plate 24 is provided with two lever projections 25*a,* 25*b* which, during moving the female connector 20 into and out of the guide member 30, abut against the rib 32 of the guide member 30 to rotate the rotary plate 24 in one or the opposite direction. The rotary plate 24 is further provided with a substantially arc-like cam groove 26 which drives the cam projection 12 of the male connector 10 toward the terminal end or the beginning end (open end) of the guide groove 23.

As shown in FIG. 2, the guide member 30 is installed inside a mount portion 1*a* of the vehicle instrument panel 1, and in position inside the guide member 30 is held the male connector 10 through the cooperation of the locking claws 33*a,* 33*b* and the locking recesses 13*a,* 13*b*.

The female connector 20 is provided projecting at the front of the component 2 (e.g. air conditioner and car audio) which is mounted in the mount portion 1*a* of the instrument panel 1.

The entire length of the guide groove 23 of the female connector 20 is set shorter than or equal to the projecting length of a lock rib 2*a* of the component 2 such that, in guiding the female connector 20 along the guide member 30 and mounting the component 2 in the mount portion 1*a* of the instrument panel 1, the male and female connectors 10, 20 are coupled to each other in the guide member 30 prior to or simultaneously with the completion of the mounting of the component 2 in the mount portion 1*a*.

Figure 3A:
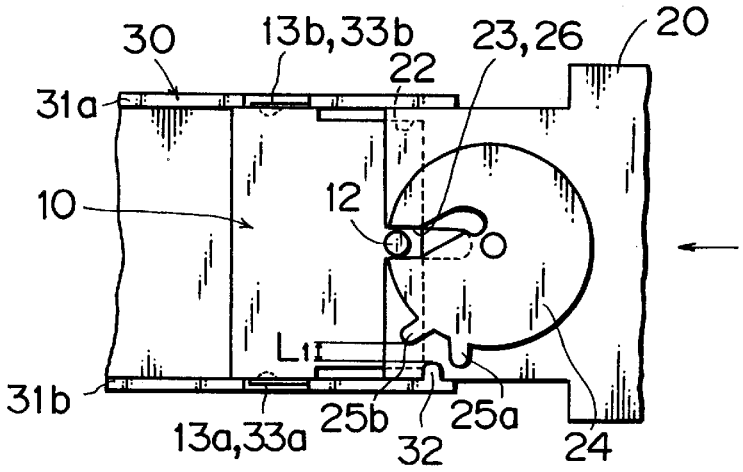
FIGS. 3A to 3C are explanatory views showing the coupling operation of the connectors of the low coupling force connector assembly.
Figure 3B:
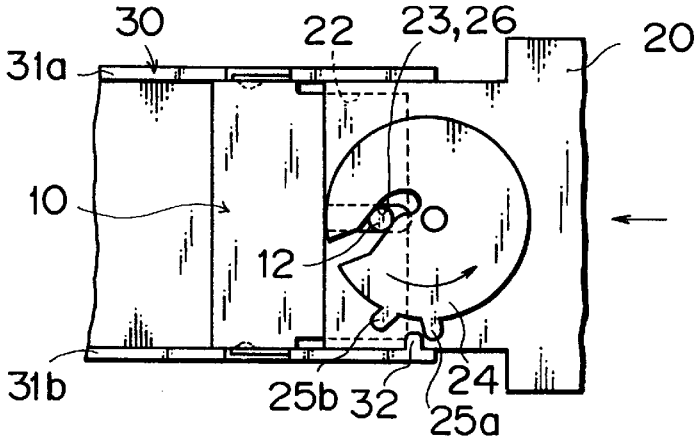
Figure 3C:
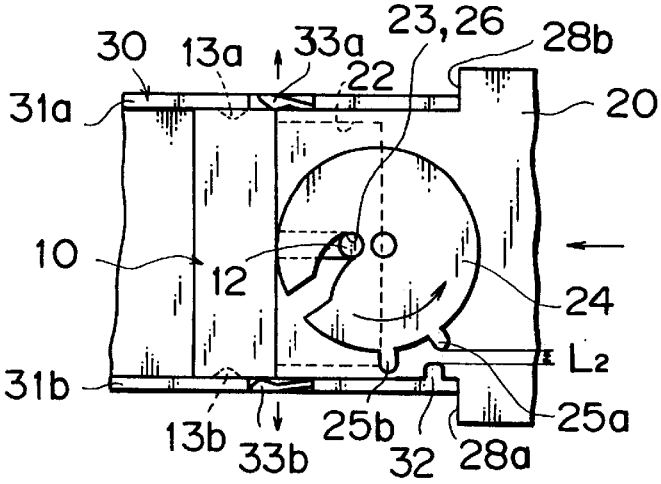

The coupling and decoupling operations of the male and female connectors 10, 20 will now be described with reference to FIGS. 3A to 3C and FIGS. 4A to 4C, of which FIGS. 3A to 3C illustrate the coupling operation and FIGS. 4A to 4C the decoupling operation.

The locking claws 33*a,* 33*b* and the locking recesses 13*a,* 13*b* are first engaged with each other to set the male connector 10 in position in the guide member 30 provided on the instrument panel 1, while the rotary plate 24 of the female connector 20 is rotated to bring the open ends (beginning ends) of its cam groove 26 and of the guide groove 23 into alignment with each other.

The component 2, as shown in FIG. 3A, is then pushed into the mount portion 1*a* of the instrument panel 1, with the female connector 20 inserted into the guide member 30, so that the female connector 20 advances along the guide member 30 toward the male connector 10 until a front end portion of the male connector 10 is located inside the receiver portion 22 of the female connector 20, at which time the cam projection 12 of the male connector 10 is introduced into the open ends of the female connector guide groove 23 and of the cam groove 26.

In this instance, a clearance $L_1$ is formed between the rib 32 of the guide member 30 and the lever projection 25 of the rotary plate 24, the one closer to the cam groove 26, to allow passage of the lever projection 25*b* over the rib 32.

If the component 2 and thus the female connector 20 are further pushed in, it brings the other lever projection 25*a* into abutment against the rib 32 as shown in FIG. 3B to rotate the rotary plate 24 in the direction shown by an arrow in this figure. Thus, the cam groove 26 produces a force which drives the cam projection 12 toward the terminal end of the guide groove 23, with the result that the male connector 10 is pulled deeper inside the receiver portion 22 of the female connector 20.

On further pushing the component 2 into the instrument panel mount opening 1*a,* as shown in FIG. 3C, the male connector 10 is pushed by the female connector 20, while causing release of the locking recesses 13*a,* 13*b* from the locking claws 33*a,* 33*b,* into a fully inserted position in the receiver portion 22 of the female connector 20 to fully couple the male and female connectors 10, 20.

At the completion of coupling the male and female connectors 10, 20, i.e., at the completion of mounting the component 2 in the instrument panel mount portion 1*a,* shoulder portions 28*a,* 28*b* of the female connector 20 abut against the side walls 31*a,* 31*b* of the guide member 30 to check further advancement of the female connector 20.

Thus, by the component 2 mounted in position in the mount portion 1*a* of the instrument panel 1, a worker can know through a tactile sense and visually that the coupling of the connectors 10, 20 has been completed.

Figure 4A:
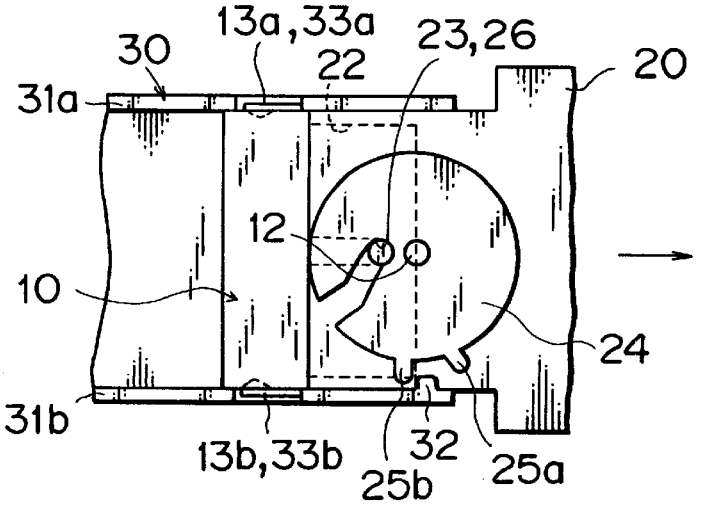
FIGS. 4A to 4C are explanatory views showing the decoupling operation of the connectors of the low coupling force connector assembly.

To decouple the male and female connectors 10, 20, if the component 2 is pulled in the direction out of the instrument panel mount portion 1*a,* the coupled male and female connectors 10, 20, as shown in FIG. 4A, move backwardly along the guide member 30 so that the locking claws 33*a,* 33*b* re-engage in the locking recesses 13*a,* 13*b*.

In this instance, since as shown in FIG. 3C a clearance $L_2$ is formed between the other lever projection 25*a* of the rotary plate 24 and the rib 32 of the guide member 30, as the female connector 20 retreats, the other lever projection 25*a* is allowed to pass over the rib 32 as shown in FIG. 4A.

Figure 4B:
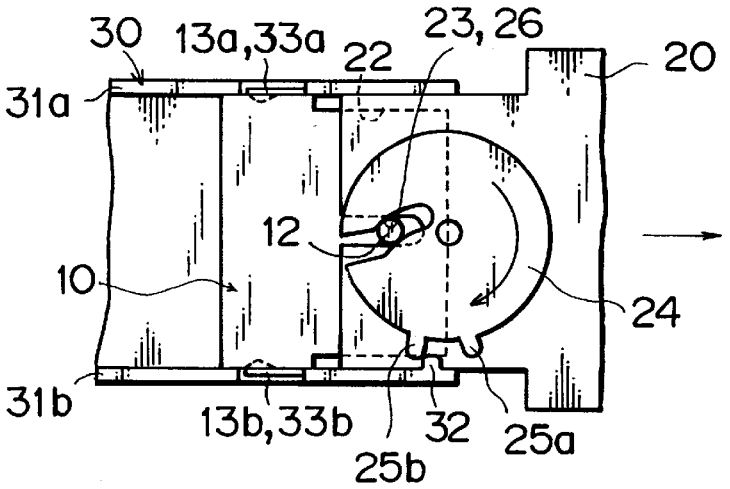

If the component 2 and thus the female connector 20 are further pulled back, it brings the lever projection 25*b* into abutment against the rib 32 as shown in FIG. 4B to rotate the rotary plate 24 in the direction shown by an arrow in this figure. Thus, the cam groove 26 produces a force which drives the cam projection 12 toward the open end of the guide groove 23 and toward decoupling of the female and male connectors 20 and 10 from each other.

Figure 4C:
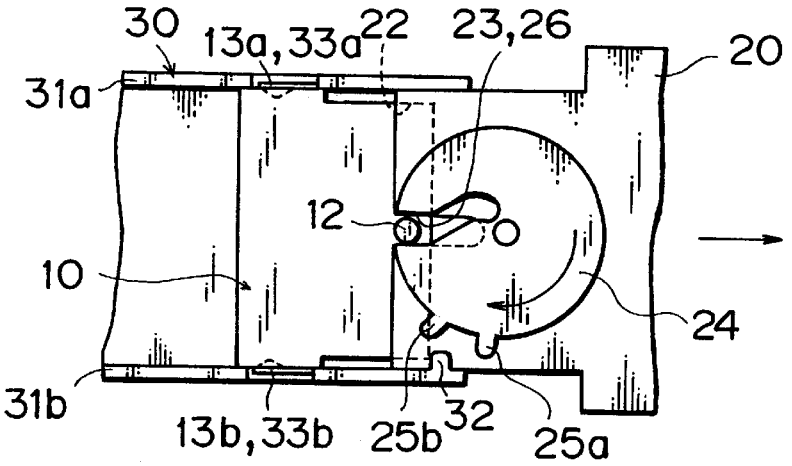

If the component 2 is further pulled back, as shown in FIG. 4C, the male connector 10 is released from the receiver portion 22 of the female connector 20 so that the component 2 is removed from the instrument panel mount portion 1*a*.

Thus, with the low coupling force connector assembly according to the present embodiment of this invention, due to the cam groove 26 which drives the cam projection 12 toward the terminal end of the guide groove 23, a reduction is made in the force required to insert the male connector 10 into the female connector 20, making it possible to couple the connectors 10, 20 together with a low coupling force merely by advancing the female connector 20 along the guide member 30 to the male connector 10.

Further, concurrently with mounting the component 2 on the instrument panel 1, the male and female connectors 10, 20 are coupled together, thereby enabling a "one-touch" mounting of the component 2 on the instrument panel 1.

Further, on completion of the mounting of the component 2, the completion of the coupling of the male and female connectors 10, 20 can be known through a tactile sense (e.g. through the abutment of the female connector shoulder portions 28*a,* 28*b* against the side walls 31*a,* 31*b*) and visually (e.g. through alignment of outer surfaces of the component 2 and the instrument panel 1).

The male connector 10 is held in position in the guide member 30 with locking means of simple structure consisting of the locking claws 13*a,* 13*b* and recesses 33*a,* 33*b* which are easily disengageable when the male connector 10 is pushed by the female connector 20 coming along the guide member 30.

In addition, if the locking claws 13*a,* 13*b* and recesses 33*a,* 33*b* are not disengaged, it indicates that the male and female connectors 10, 20 are not yet coupled together, at which time the component 2 is still protruding from the mount portion 1*a* of the instrument panel 1. Thus, an incomplete coupling of the male and female connectors 10, 20 can be easily known.

While in the above example, to retain the male connector 10 in position in the guide member 30, the locking claws 33*a,* 33*b* are provided on the guide member 30 and the corresponding locking recesses 13*a,* 13*b* on the male connector 10, it is also possible to provide them reversely, i.e., the former on the male connector 10 and the latter on the guide member 30.

Further, it is also possible to provide the guide member 30 and the male connector 10 on the side of the component 2 and the female connector 20 on the side of the instrument panel 1.

Further, it is to be noted that the low coupling force connector assembly according to this invention is applicable not only to connecting the instrument panel 1 and the component 2 as in the first embodiment as described above, but also to connecting other various members.

A low coupling force connector assembly according to a second embodiment of this invention will now be described with reference to FIGS. 5A and 5B.

Figure 5B:
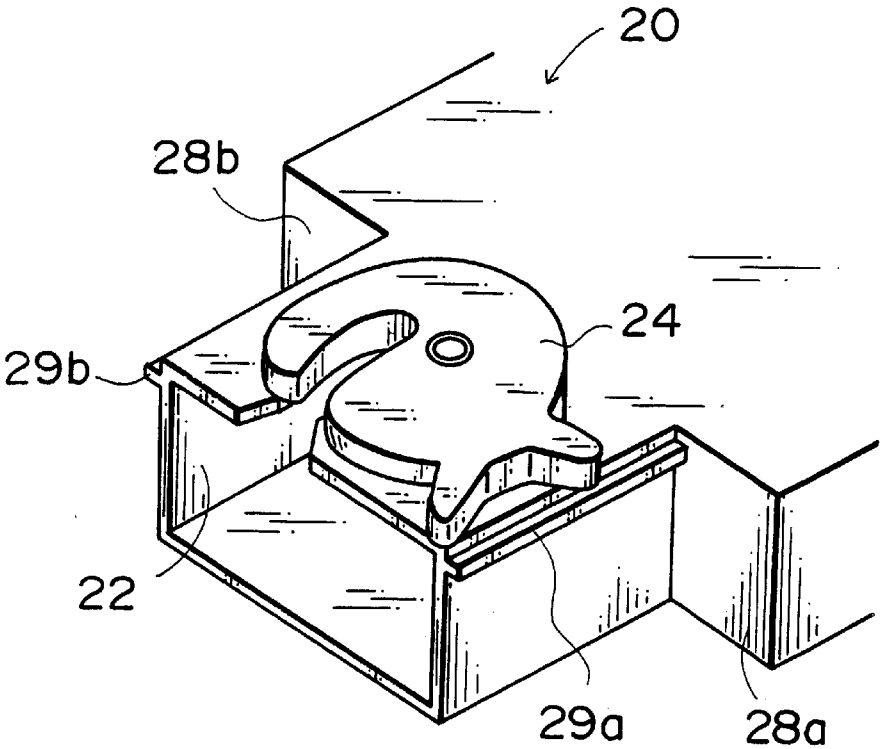
FIG. 5B is a perspective view of a female connector used with the guide member.
Figure 5A:
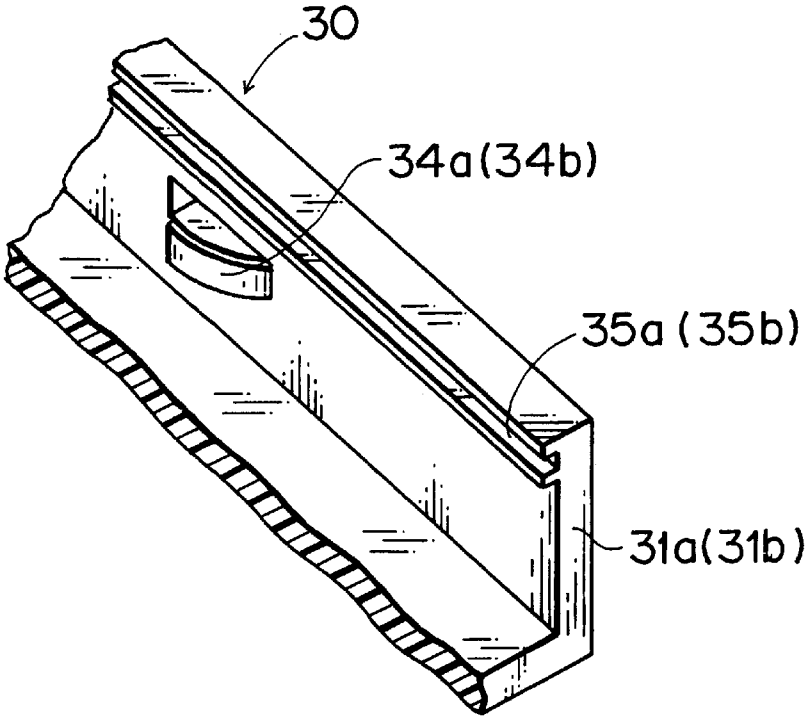
FIG. 5A is a partially cutaway view showing an essential portion of a guide member according to a second embodiment of this invention.

This low coupling force connector assembly includes, as the locking means on the side of the guide member 30 matable with the locking recesses 13*a,* 13*b* on the side of the male connector 10, locking pieces 34*a,* 34*b* in the form of a plate spring protruding at the opposite guide member side walls 31*a,* 31*b* as shown in FIG. 5A.

The low coupling force connector assembly, as shown in FIGS. 5A and 5B, further includes slide grooves 35*a,* 35*b* formed on the opposite guide member side walls 31*a,* 31*b* and slide ribs 29*a,* 29*b* protruding at opposite side walls of the female connector receiver portion 22 for sliding engagement in the slid grooves 35*a,* 35*b*.

With the construction as mentioned above, the plate spring-like locking pieces 34*a,* 34*b* cooperate with the male connector locking recesses 13*a,* 13*b* to retain the male connector 10 in position in the guide member 30 as do the locking claws 33*a,* 33*b* in the preceding example, while facilitating the forward and backward movement of the female connector 20 along the guide member 30.

A low coupling force connector assembly according to a third embodiment of this invention will now be described with reference to FIGS. 6, 7A to 7C and 8A to 8C.

Figure 6:
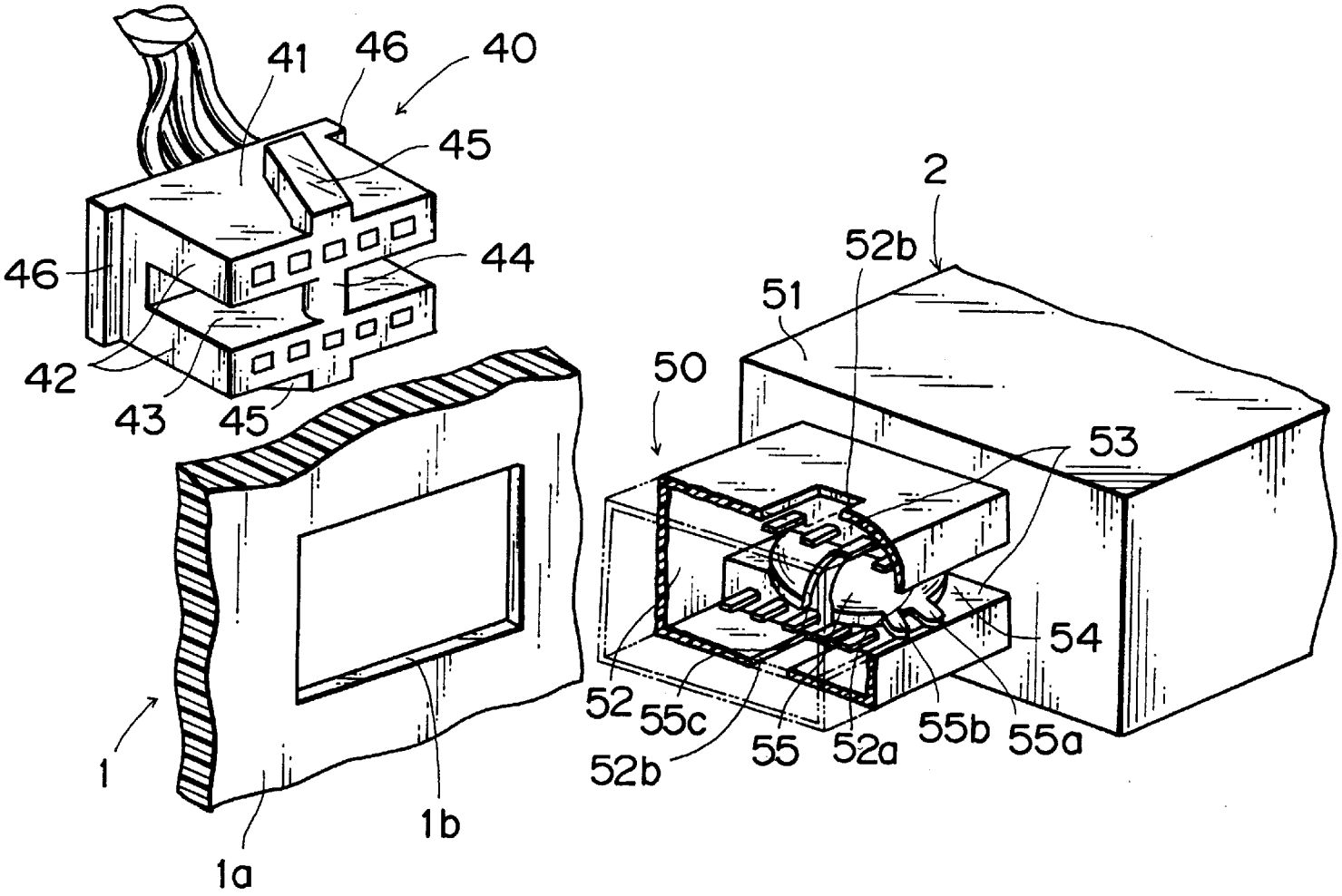
FIG. 6 is an exploded perspective view of a low coupling force connector assembly according to a third embodiment of this invention.

In FIG. 6, the low coupling force connector assembly has a male connector 40 engaged in a rectangular mount hole 1*b* provided in the instrument panel 1 inside the mount portion 1*a* (FIG. 2), and a female connector 50 provided on the component 2 which is mounted on the instrument panel 1.

The male connector 40 includes a housing 41, upper and lower female terminal accommodating chambers 42, 42 with a hollow space 43 formed therebetween, and a cam projection 44 located in the hollow space 43. The housing 41 has resilient locking arms 45, 45 on its upper and lower outer walls and locking ribs or flanges 46, 46 projecting at its opposite sides at the rear end.

The female connector 50 has a housing 51 with a rectangular receiver portion 52 provided at the front end for receipt therein of the male connector 40. Upper and lower walls of the receiver portion 52 are formed with respective escape holes 52*b,* 52*b,* and a side wall thereof with a longitudinally extended cutout 52*a*.

Figure 7A:
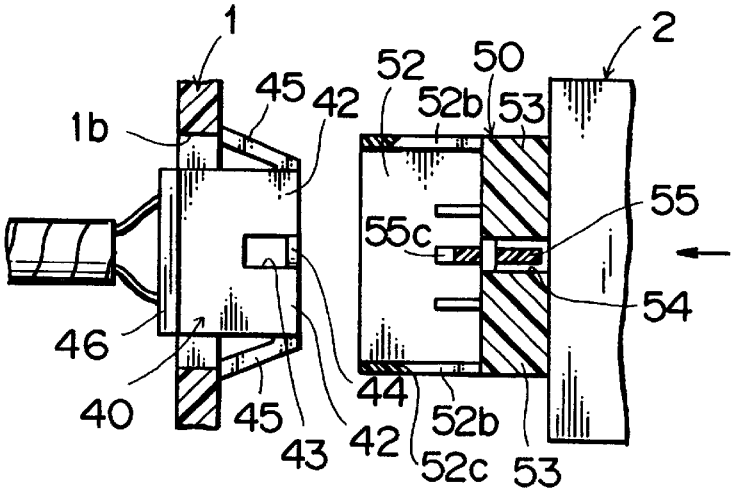
FIGS. 7A to 7C are vertical sectional views showing the coupling operation of connectors of the low coupling force connector assembly as in FIG. 6.

The locking arms 45, 45 and the locking ribs 46, 46 of the male connector 40 engage with circumferential edges of the instrument panel mount hole 1*b* when the male connector 40 is inserted into the mount hole 1*b* to hold the male connector 40 in place in the mount hole 1*b* (FIG. 7A). The locking arms 45, 45, when the male connector 40 is inserted into the receiver portion 52 of the female connector 40, are received in the related escape holes 52*b*, 52*b* provided in the upper and lower walls of the receiver portion 52 (FIG. 7).

The female connector receiver portion 52 has upper and lower male terminal accommodating chambers 53, 53 with a hollow space 54 formed therebetween. A rotary plate 55 is rotatably mounted in the hollow space 54, the rotary plate having at its peripheral edge two lever projections 55*a*, 55*b* projecting through the cutout 52*a* of the receiver portion 52 for abutment against circumferential edges of the instrument panel mount hole 1*b* to rotate the rotary plate 55 in one or the opposite direction. The rotary plate 55 also has a substantially arc-like cam groove 55*c* which the cam projection 44 of the male connector 40 follows during coupling and decoupling of the connectos 40, 50 to move the male connector 40 into and out of the female connector 50 in accordance with a direction of rotation of the rotary plate 55.

At front ends of the escape holes 52*b*, 52*b* are formed tapered surfaces 52*c*, 52*c* inclined forwardly inwardly (FIGS. 7A to 7C) along which, when the female connector 50 is detached from the male connector 40, the locking arms 45, 45 are guided from the related escape holes 52*b*, 52*b* (FIG. 7C) into the receiver portion 52.

The coupling operation of the connectors 40, 50 of the low coupling force connector assembly will now be described with reference to FIGS. 7A to 7C and 8A to 8C.

Figure 7B:
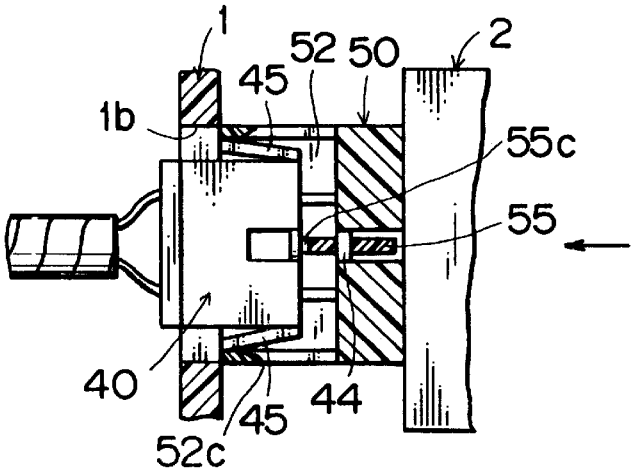
Figure 8A:
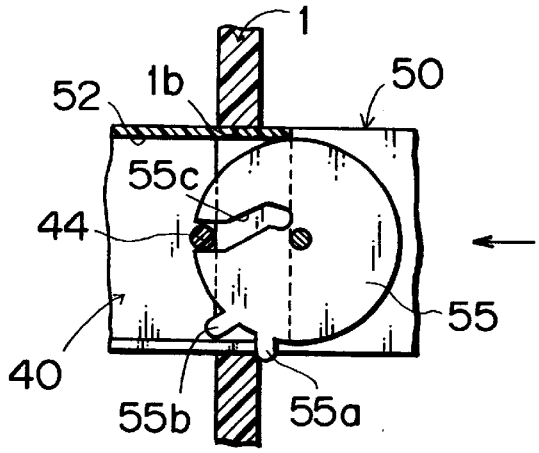
FIGS. 8A to 8C are horizontal sectional views showing the coupling operation of the connectors of the low coupling force connector assembly as in FIG. 6.

The male connector 40 is first engaged in advance in the instrument panel mount hole 1*b* as shown in FIG. 7A. As shown in FIG. 7B, the female connector 50, which is attached to the component 2, is then inserted into the mount hole 1*b*, with the male connector 40 inserted into the receiver portion 52 of the female connector 50, so that the locking arms 45, 45 of the male connector 40 are disengaged from the mount hole 1*b* and received inside the female connector receiver 52, at which time, as shown in FIG. 8A, the cam projection 44 of the male connector 40 is introduced into the cam groove 55*c* provided in the rotary plate 55 of the female connector 50.

Figure 8B:
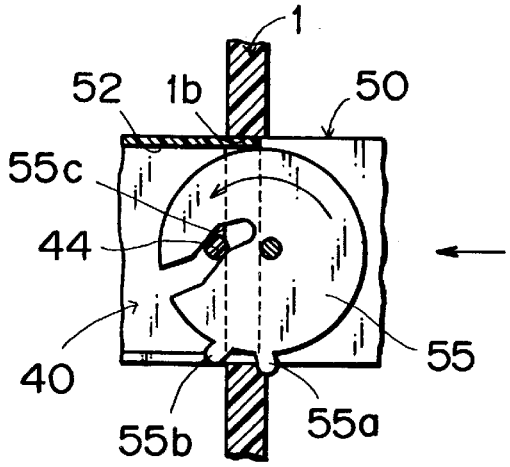

Then, as the female connector 50 is inserted, as shown in FIG. 8B, one of the lever projections 55*a* of the rotary plate 55, the one remote from the cam groove 55*c*, comes into contact with the circumferential edge of the mount hole 1*b* to rotate the rotary plate 55 in the direction shown by an arrow in this figure. Consequently, the cam groove 55*c* of the rotary plate 55 drives the cam projection 44 toward its terminal end to bring the male connector 40 into the female connector 50.

Figure 7C:
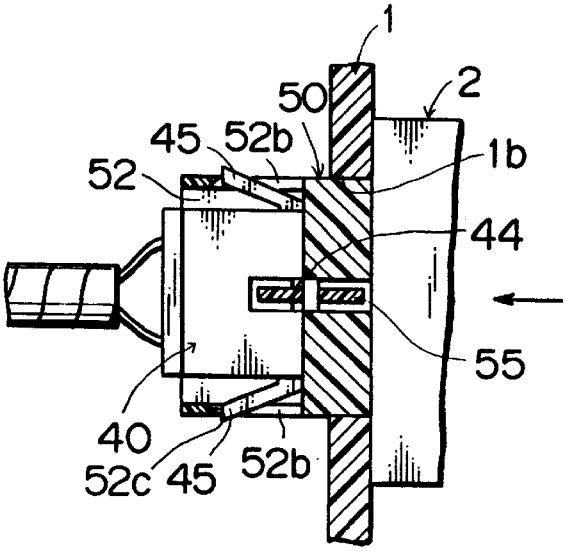
Figure 8C:
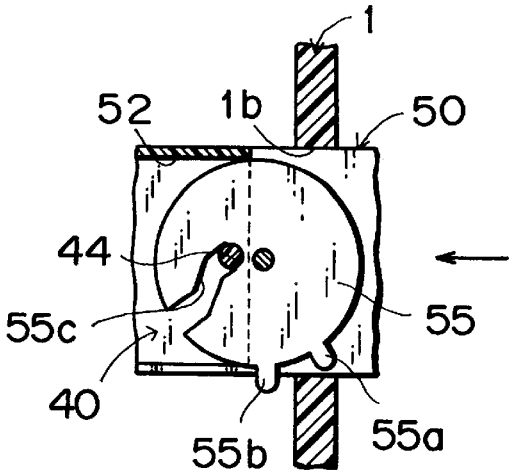
Figure 9:
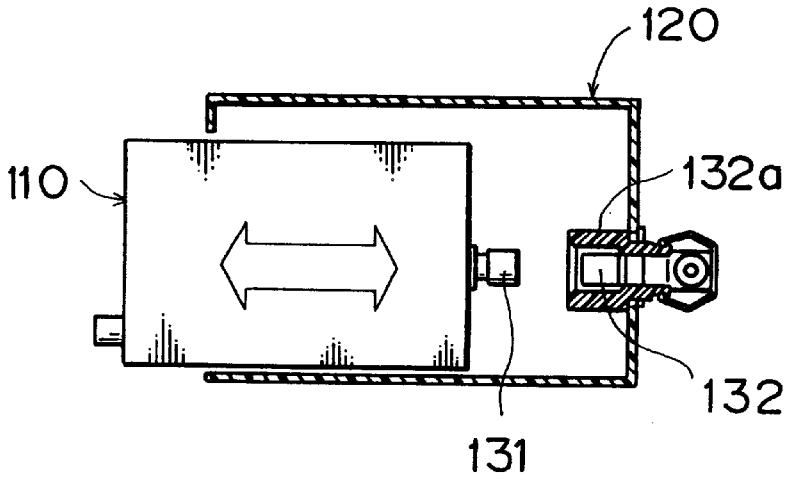
FIG. 9 PRIOR ART
FIG. 9 is a vertical sectional view of a conventional connector assembly of a plug-in type.
Figure 10:
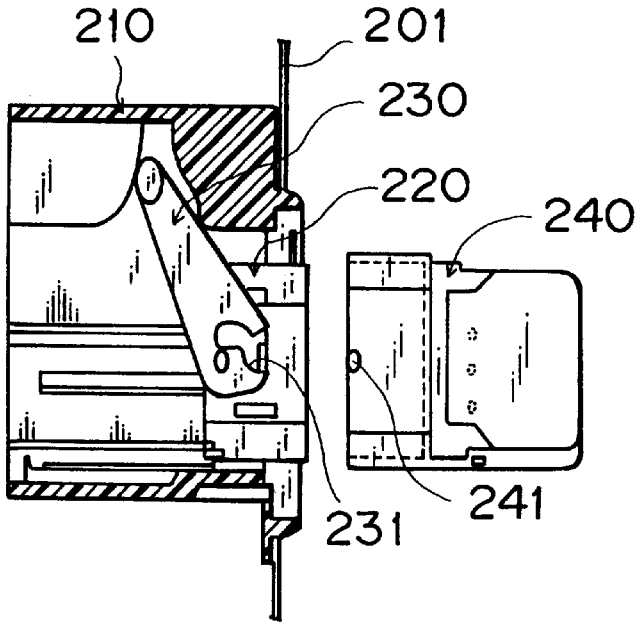
FIG. 10 PRIOR ART
FIG. 10 is a vertical sectional view of a conventional connector assembly with a lever.
Figure 11B:
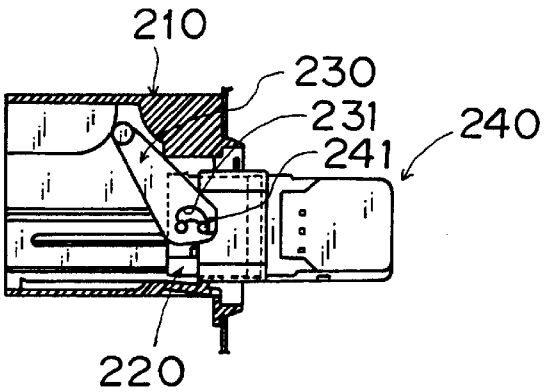
FIG. 11B PRIOR ART
FIGS. 11A to 11D are explanatory views of the coupling operation in the conventional connector assembly with the lever as in FIG. 10.
Figure 11D:
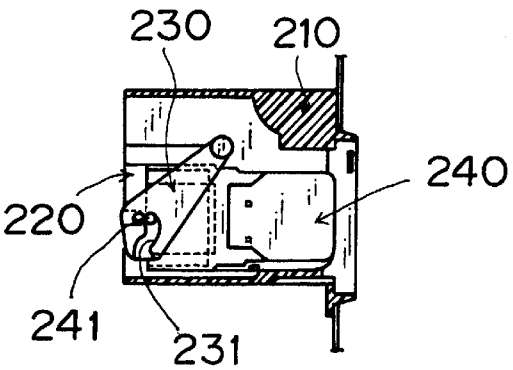
FIG. 11D PRIOR ART
Figure 11A:
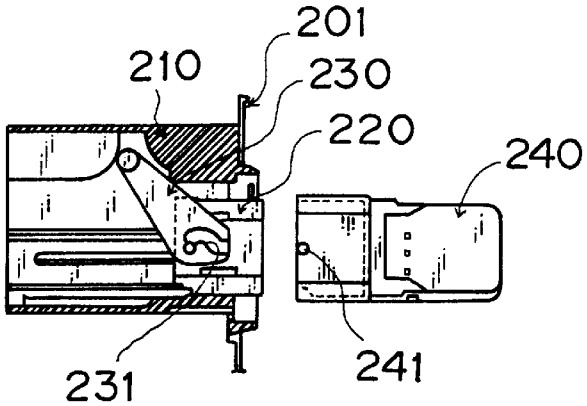
FIG. 11A PRIOR ART
Figure 11C:
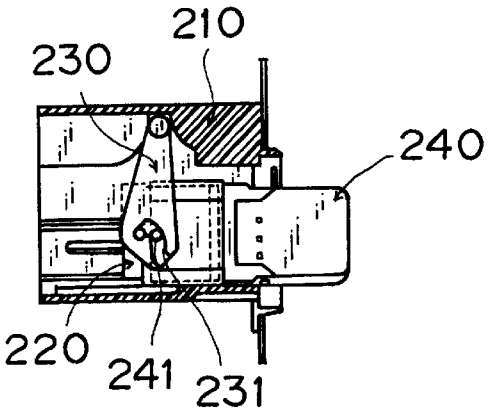
FIG. 11C PRIOR ART

As the female connector 50 is further pushed in, as shown in FIGS. 7C and 8C, the cam projection 44 arrives at the terminal end of the cam groove 55*c*, and the locking arms 45, 45 are received in the related escape holes 52*b*, 52*b* of the receiver portion 52 to fully couple the male connector 40 to the female connector 50.

To demount the component 2 from the instrument panel 1, the component 2 is pulled in the direction out of the mount portion 1*a* to bring the other lever projection 55*b* of the rotary plate 55 from the condition shown in FIG. 8C into contact with the circumferential edge of the mount hole 1*b* and rotate the rotary plate 55 reversely. The male and female connectors 40, 50 are then decoupled from each other in the order reverse to that mentioned above.

With the construction as described above, the male and female connectors 40, 50 can be coupled together concurrently with mounting the component 2 on the instrument panel 1 as is the case in the preceding first and second embodiments of this invention, while making it possible to dispense with the guide member 30 as used in the first and second embodiments, leading to a simplified and weighing-light construction.

Further, by engaging the male connector 40 in the instrument panel mount hole 1*b* with the locking arms 45, 45, the male connector 40 is stationarily positioned relative to the female connector 50 which is inserted into the mount hole 1*b* to attain a smooth coupling of the male and female connectors 40, 50.

As mentioned hereinabove, according to the present invention, two members are connector-connected concurrently with their assembly to each other, a reduction is made in the force required for the connector-connection, and the completion of coupling of the connectors is confirmed through a tactile sense and visually.

Having now fully described the invention, it will be apparent to one of ordinary skill in the art that many changes and modifications can be made thereto without departing from the spirit and scope of the invention as set forth herein.

What is claimed is:

1. A low coupling force connector assembly comprising:

a first connector having a housing and a cam projection provided on said housing;

a second connector having a housing with a receiver portion for receiving said first connector, said receiver portion having a straight guide groove formed in a wall thereof for guiding said cam projection of said first connector;

a guide member with opposed side walls for receipt therebetween of said first connector and guiding said second connector to said first connector, one of said side walls having a rib projecting thereon;

locking means for holding said first connector in position in said guide member; and a rotary plate rotatably provided on said wall of said second connector receiver portion, said rotary plate having at a peripheral edge thereof two lever projections for contacting said rib of said guide member to rotate said rotary plate in one or an opposite direction and a substantially arc-like cam groove for driving, during coupling and decoupling of said first and second connectors, said cam projection of said first connector to a terminal end or a beginning end of said guide groove in said second connector receiver portion in accordance with a direction of rotation of said rotary plate.

2. The low coupling force connector assembly according to claim 1, further comprising an instrument panel of a vehicle and a component to be mounted on said instrument panel, wherein said guide member and thus said first connector are provided on said instrument panel and said second connector is provided on said component, and wherein in inserting said second connector between said side walls of said guide member and mounting said component on said instrument panel, said first and second connectors are coupled to each other prior to or concurrently with completion of mounting said component on said instrument panel.

3. The low coupling force connector assembly according to claim 1, further comprising an instrument panel of a vehicle and a component to be mounted on said instrument panel, wherein said second connector is provided on said instrument panel and said guide member and thus said first connector are provided on said component, and wherein in inserting said second connector between said side walls of said guide member and mounting said component on said instrument panel, said first and second connectors are coupled to each other prior to or concurrently with completion of mounting said component on said instrument panel.

4. The low coupling force connector assembly according to claim 1, wherein said locking means comprises resilient locking claws projecting at said side walls of said guide member and corresponding locking recesses provided on opposite side walls of said first connector housing.

5. The low coupling force connector assembly according to claim 1, wherein said locking means comprises resilient locking claws projecting at opposite side walls of said first connector housing and corresponding locking recesses provided on said side walls of said guide member.

6. The low coupling force connector assembly according to claim 1, wherein said locking means comprises locking pieces in the form of a plate spring projecting at said side walls of said guide member and corresponding locking recesses provided on opposite side walls of said first connector housing.

7. The low coupling force connector assembly according to claim 1, further comprising slide grooves provided on said opposed side walls of said guide member and corresponding slide ribs provided on opposite side walls of said second connector housing for sliding engagement in said slide grooves.

8. A low coupling force connector assembly comprising:

a male connector engaged in a mount hole provided in an instrument panel of a vehicle, said male connector having upper and lower female terminal accommodating chambers with a hollow space formed therebetween and a cam projection provided in said hollow space;

a female connector provided on a component which is mounted on said instrument panel, said female connector having a receiver portion for receiving said male connector, said receiver portion having upper and lower male terminal accommodating chambers with a hollow space formed therebetween and a cutout longitudinally extended in a wall thereof;

a rotary plate rotatably provided in said hollow space of said female connector receiver portion, said rotary plate having at a peripheral edge thereof two lever projections which project through said cutout for contacting a circumferential edge of said instrument panel mount hole to rotate said rotary plate in one or an opposite direction and a substantially arc-like cam groove for driving therealong said cam projection of said male connector to bring said male connector into and out of coupling with said female connector in accordance with a direction of rotation of said rotary plate.

9. The low coupling force connector assembly according to claim 8, further comprising escape holes provided in opposite walls of said female connector receiver portion and locking arms provided on corresponding opposite walls of said male connector for engagement with said instrument panel to position said male connector in said mount hole and for engagement in said escape holes in said female connector receiver portion.

* * * * *